United States Patent [19]

Keys

[11] Patent Number: 4,504,385

[45] Date of Patent: Mar. 12, 1985

[54] ESTER-ALCOHOL FROTHERS FOR FROTH FLOTATION OF COAL

[75] Inventor: Robert O. Keys, Columbus, Ohio

[73] Assignee: Sherex Chemical Company, Inc., Dublin, Ohio

[21] Appl. No.: 454,607

[22] Filed: Dec. 30, 1982

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,912,433 | 6/1933 | Crago et al. . | |
| 1,968,876 | 8/1934 | Crago et al. | 252/61 |
| 2,099,120 | 11/1937 | Kirby et al. | 209/166 |
| 2,166,093 | 7/1939 | Harwood et al. | 209/166 |
| 2,175,093 | 10/1939 | Ralston et al. | 209/166 |
| 2,298,281 | 10/1942 | Corley et al. | 209/166 |
| 2,312,466 | 3/1943 | Erickson et al. | 209/166 |
| 2,591,289 | 4/1952 | Powell et al. | 209/166 |
| 2,657,800 | 11/1953 | Hall | 209/166 |
| 2,669,355 | 2/1954 | Archibald et al. | 209/166 |
| 2,695,101 | 11/1954 | Booth et al. | 209/166 |
| 2,803,345 | 8/1957 | Jacobs | 209/166 |
| 2,944,666 | 7/1960 | Bunge et al. | 209/5 |
| 2,984,354 | 5/1961 | Carpenter et al. | 209/167 |
| 2,987,183 | 6/1961 | Bishop | 209/166 |
| 4,196,092 | 4/1980 | Wang | 252/61 |
| 4,253,944 | 3/1981 | Hefner | 209/166 |
| 4,278,533 | 7/1981 | Hefner | 209/166 |
| 4,308,133 | 12/1981 | Meyer | 209/166 |
| 4,308,815 | 12/1981 | Hefner | 209/166 |
| 4,332,593 | 6/1982 | Burgess et al. | 44/51 |
| 4,340,467 | 7/1982 | Wang et al. | 209/166 |
| 4,377,473 | 3/1983 | Laros et al. | 209/167 |
| 4,389,306 | 6/1983 | Nakanishi et al. | 209/5 |
| 4,394,257 | 7/1983 | Wang et al. | 209/166 |

FOREIGN PATENT DOCUMENTS

| | | | |
|---|---|---|---|
| 162191 | 3/1955 | Australia | 209/166 |
| 1108317 | 9/1981 | Canada . | |
| 16914 | 10/1980 | European Pat. Off. . | |
| 2734670 | 3/1978 | Fed. Rep. of Germany . | |
| 125488 | 10/1981 | Japan . | |
| 104569 | 12/1979 | Poland . | |
| 741085 | 11/1955 | United Kingdom . | |
| 2072700 | 3/1980 | United Kingdom . | |
| 2093735 | 9/1982 | United Kingdom . | |
| 882626 | 11/1981 | U.S.S.R. . | |

*Primary Examiner*—Bernard Nozick

*Attorney, Agent, or Firm*—Mueller and Smith

[57] ABSTRACT

Disclosed is an improved process wherein coal particles are beneficiated by froth flotation under coal froth flotation conditions to separate the desired coal particles from remaining unwanted ash and like gangue material. The improvement of the present invention comprises conducting the froth flotation in the presence of an ester-alcohol frothing agent. The preferred ester-alcohol frothing agents are reaction products of $C_1$–$C_{10}$ mono-basic carboxylic acids and diols wherein the total number of carbon atoms range from about 6–19 and monocarboxylic acid esters of polyoxyalkylene glycols which can contain up to 25–30 carbon atoms.

19 Claims, 1 Drawing Figure

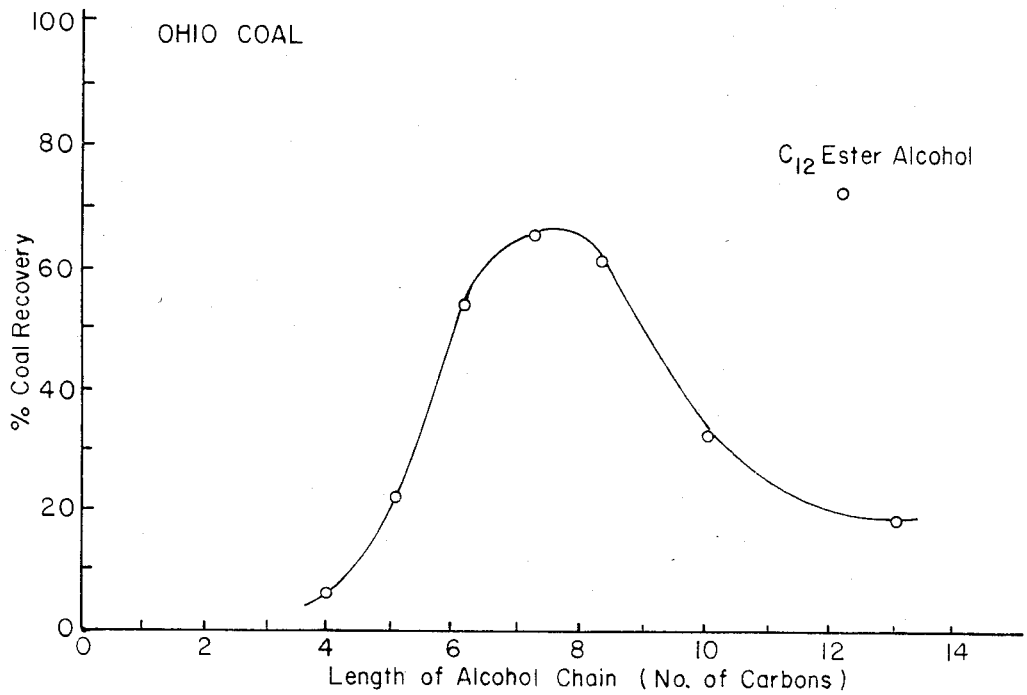
OHIO COAL
$C_{12}$ Ester Alcohol
% Coal Recovery
100
80
60
40
20
0
0
2
4
6
8
10
12
14
Length of Alcohol Chain (No. of Carbons)
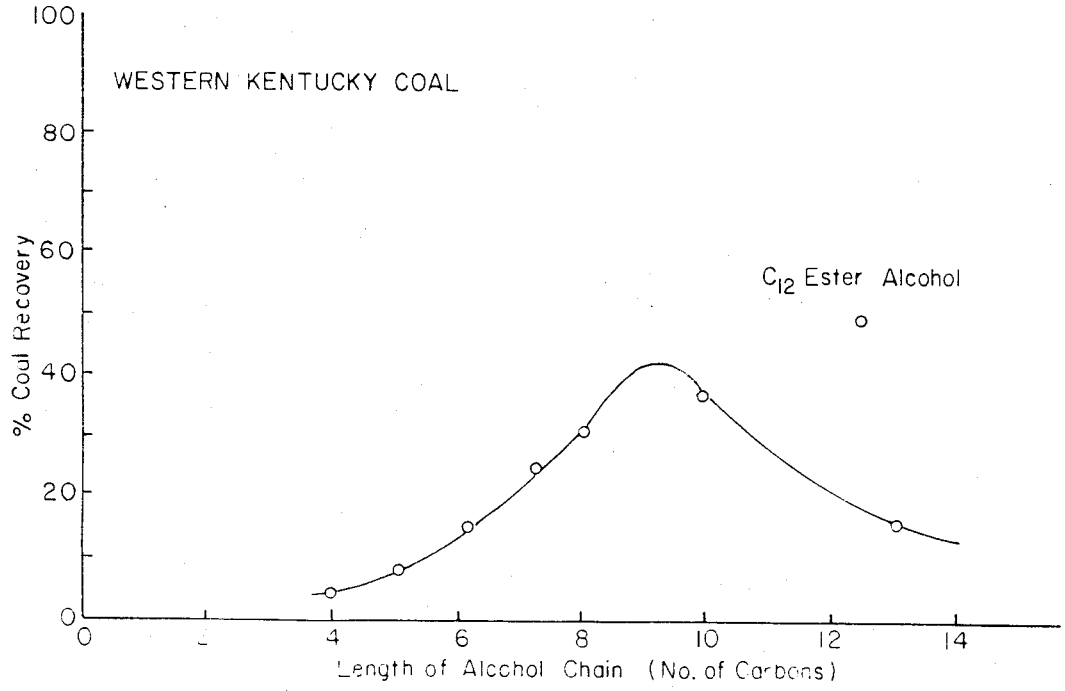
WESTERN KENTUCKY COAL
$C_{12}$ Ester Alcohol
% Coal Recovery
100
80
60
40
20
0
0
4
6
8
10
12
14
Length of Alcohol Chain (No. of Carbons)

ESTER-ALCOHOL FROTHERS FOR FROTH FLOTATION OF COAL

BACKGROUND OF THE INVENTION

The present invention relates to the froth flotation of finely-divided coal particles for separation of ash therefrom and more particularly to a new frothing agent or frother which enhances the coal recovery in the froth flotation process.

Coalification is a natural process which results in the deposits of combustible carbonaceous solids in combination with some non-combustible mineral matter. Most coal cleaning is carried out by gravity separation methods utilizing jigs, shaking tables, heavy media or cyclones, and like techniques. The fine coal therefrom has been incorporated into clean coal or simply discarded in the past; however, due to economic and environmental considerations gained by recovery of the fine coal fraction, fine coal beneficiation has become a necessity in most coal operations requiring any degree of preparation. Froth flotation is one method which has been practiced for cleaning the fine coal.

The use of froth flotation to effect a separation of pyritic sulfur and ash particles from coal can be achieved only if liberation of these unwanted particles from the coal has taken place. Most high-grade coals are floatable naturally due to their hydrophobic surface and typically only require a frothing agent for effecting flotation. A frothing agent imparts elasticity to the air bubble, enhances particle-bubble attachment so that the coal is buoyed to the surface of the slurry. The flotability of coal can vary within a given seam at a mine depending upon the exposure of the locale to weathering elements or the blending of coals from different seams. Butuminous and lower grade coals either possess an oxidized condition as mined or undergo oxidation (weathering) when the coal is stored or stockpiled for later processing. Coal that has been oxidized does not respond well to froth flotation. As the degree of oxidation increases, coal becomes increasingly hydrophilic and, therefore, less coal readily can be floated. Heretofore, oxidized coal which was not flotable was discarded in the tailing of the flotation proces with little attempt to recover this loss being undertaken.

Conventional frothing agents or frothers in the coal flotation process generally have been short-chain alkanols, terpene alcohols such as alpha-terpineol, short-chain glycols, sorbitol derivatives, ethoxylated alcohols, and mixed alkylene oxide glycol ethers. While such alcohol frothers function in the coal float, the need for improved alcohol frothers yet exists. The present invention provides improved high coal recoveries with improvements in coal quality utilizing a novel alcohol promoter which is highly effective and can be inexpensive to manufacture.

BROAD STATEMENT OF THE INVENTION

The present invention is directed to a froth flotation process for beneficiating coal wherein solid coal particles are selectively separated under coal froth flotation conditions as the froth phase from remaining solid feed particles as an aqueous phase in the presence of a coal particle collector (which preferably is a fuel oil) and an alcohol frother. The improvement in such process is characterized by said alcohol frother comprising an alcohol frother which contains a carboxylic acid ester linkage. Representative of such ester-alcohol frothers are, for example, esters of $C_1$–$C_{10}$ monobasic acid and diols (preferably containing a total of from 6 to 19 carbon atoms); dicarboxylic acid esters of $C_1$–$C_{10}$ dibasic acids and a triol or a mixture of a monool, a glycol, etc. retaining at least one alcohol group (and preferably having a total of from 6 to 19 carbon atoms); an ester of a $C_1$–$C_{10}$ monobasic acid and triol (preferably having from 6 to 19 carbon atoms); and a monocarboxylic acid ester of a polyoxyalkylene glycol (containing up to 25–30 carbon atoms); and the like. Preferably no more than three ester linkages are contained in the novel ester-alcohol frother and preferably the frother contains alkyl branching, especially methyl branching, and the hydroxyl group is a secondary (or tertiary) alcohol group.

Advantages of the present invention include the ability to improve recovery of coal particles during the froth flotation process without increasing the proportion of ash in the concentrate. Another advantage is the ability to improve the coal recovery without increasing the proportion of collector and frother used in the float. These and other advantages will become readily apparent to those skilled in the art based upon the disclosure contained herein.

BRIEF DESCRIPTION OF THE DRAWING

The drawing displays graphically the results obtained in coal froth flotation tests reported and described in Example 2. A detailed description of the conditions of such tests and the results obtained is given in connection with Example 2.

DETAILED DESCRIPTION OF THE INVENTION

A wide variety of ester-alcohol frothers have been determined to be highly effective in the beneficiation of coal by the froth flotation process. Most of these frothers will be alcohol frothers or derivatives of alcohol frothers which have been modified to contain a carboxylic acid ester linkage. Heretofore, the art has not recognized the beneficial effects which are imparted to the alcohol frothers by incorporating a carboxylic acid ester linkage therein.

While a wide variety of ester-alcohol frothers can be synthesized in accordance with the precepts of the present invention, it will be apparent that not all of such frothers can be expressly set forth herein. One difficulty in setting forth an inclusive list of such novel frothers is the uncertainty in the art in determining whether a particular alcohol will function effectively in the coal flotation process. Neither decreased solubility nor the rate of surface tension lowering has been determined to be the decisive parameter in the choice of alcohol as flotation frothers. Rather, the structure of the frother molecule appears to play a dominant role when analyzed in combination with a given collector which is to be used on a given particle to be floated. A review of these and other factors is presented by Jan Leja in *Surface Chemistry of Froth Flotation,* pp 307–319, Plenum Press, New York, NY (1982). With the disclosure of the novel frothers of this invention, it is likely that the classes of appropriate alcohols for coal froth flotation may be redefined.

Referring now to specific ester-alcohol frothers of the present invention, several classes of conventional alcohol frothers have been determined to provide improved coal recoveries when modified with a carboxylic acid ester group. One class of conventional alcohol frothers includes alkanols, especially $C_6$–$C_{10}$ branch-chain alkanols. A novel counterpart to such conventional alkanols can be made by reacting a glycol with a monobasic acid wherein the total number of carbon atoms of the resulting ester-alcohol should range from between about 6 and 19. Alkyl branching, especially methyl branching, and a secondary hydroxyl group enhance the frothing activity of the resulting ester-alcohol frother. As the Examples will demonstrate, conventional alkanol frothers typically maximize coal recovery at about a chain length of 6 to 9 carbon atoms. The novel ester-alcohol frothers, however, maximize coal recovery at greater chain lengths, conveniently determined by total number of carbon atoms. For simple ester-alcohols of a diol and a $C_1$–$C_{10}$ monobasic acid, between about 9 and 15 carbon atoms has been determined to provide good functionality to the ester-alcohol frother, depending upon the precise structure, eg. branching, and the like. A particularly preferred ester-alcohol frother made from the reaction of 2,2,4-trimethyl-1,3-pentanediol (TMPD) with a monobasic acid shows that at about 12 total carbon atoms, coal recovery is maximized. Of course, improved coal recovery also results compared to conventional alkanol frothers.

Another class of conventional coal frothing agents are polyoxyalkylene glycol modified alkanols. Typically ethylene oxide or propylene oxide is reacted with methanol of other short-chain alcohol in a proportion ranging from 4 to 10 or more moles of alkylene oxide per mole of alkanol. The resulting polyoxyalkylene ether alcohols can be suitably modified according to the precepts of the present invention to provide improved coal recoveries. The substitution of a carboxylic acid for the lower alkanol is an effective and simple method for making a monocarboxylic acid ester of a polyoxyalkylene glycol which functions effectively in a coal froth flotation process. In fact, improved coal recovery is gained by introduction of the ester linkage to the ether alcohol frother. The multiplicity of ether linkages permits greater molecular weights to be utilized for such conventional ether alcohol frothers and the same is true of the ester-modified ether alcohol frothers of the present invention. Thus, the total number of carbon atoms can range up to 25–30 or more of such highly etherified ester-alcohol frothers.

Other suitable ester-alcohols include monoesters or diesters of triols preferably containing from 6–19 total carbon atoms and a diester of a dibasic acid and a glycol/monoalcohol mixture also containing from 6–19 total carbon atoms. Additional ester-alcohol frothing agents clearly can be conceived of and synthesized in accordance with the precepts of the present invention. So long as the alcohol provides the requisite degree of frothing required of the coal flotation process, the presence of an ester linkage will enhance the activity of the alcohol frothing functionality. The proportion of ester-alcohol in the flotation process should range from between about 0.05 to about 0.5 g/kg of coal feed.

The frothers of the present invention are used with conventional collectors and promoters. Fuel oil is the preferred collector for use in the coal flotation process. Representative fuel oils include, for example, diesel oil, kerosene, Bunker C fuel oil, and the like and mixtures thereof. The fuel oil collector generally is employed in a dosage of from about 0.2 to about 2.5 gm/kg of coal feed. The precise proportion of collector depends upon a number of factors including, for example, the size, degree of oxidation and rank of the coal to be floated, and the dosages of the promoter and frother.

The preferred promoters for use in the process are the fatty nitrile promoters disclosed in applicant's commonly-assigned application Ser. No. 434,244, filed on Oct. 14, 1982, the disclosure of which is expressly incorporated herein by reference. The proportion of such promoters typically is from about 0.01 to about 2 g/kg of solid feed particles.

Of course, conventional promoters can be used in combination with the ester-alcohols of the present invention. For example, U.S. Pat. No. 4,253,944 shows a promoter which is the condensation product of a fatty acid or fatty acid ester with an ethoxylated or propoxylated amine. U.S. Pat. No. 4,308,133 shows a promoter which is an aryl sulfonate. European patent application No. 891688732, filed Jan. 26, 1980, shows a promoter which is an alkanol amine-tall oil fatty acid condensate. U.S. Pat. No. 4,305,815 shows a promoter which is a hydroxy alkylated polyamine. U.S. Pat. No. 4,278,533 shows a promoter which is a hydroxylated ether amine. U.S. Pat. No. 4,196,092 shows a conditioning agent of a frother and a bis(alkyl)ester of a sulfosuccinic acid salt. United Kingdom Pat. No. 2,072,700 floats coal with a latex emulsion prepared from a hydrocarbon oil with a hydrophobic water in oil emulsifier and a hydrophilic surfactant. Canadian Pat. No. 1,108,317 shows anionic surfactants which are fatty sulfosuccinates. Russian Inventor's Certificate No. 882,626 proposes a collector-frother which is an ε hydroxy, chloro or sulfide derivative of the methyl or ethyl ester of caproic acid.

Suitable coal for beneficiation by the improved froth flotation process of the present invention includes anthracite, lignite, bituminous, subbituminous and like coals. The process of the present invention operates quite effectively on coals which are very difficult to float by conventional froth flotation techniques, especially where the surfaces of the coal particles are oxidized. The size of the coal particles fed to the process generally are not substantially above about 28 Tyler mesh as larger particles are extremely difficult to float. In typical commercial froth flotation operations, coal particles larger than 28 Tyler mesh, advantageously larger than 100 Tyler mesh, are separated from both inert material mined therewith and more finely divided coal by gravimetric separation techniques. The desirable cut or fraction of coal fed to the process for flotation preferably is initially washed and then mixed with sufficient water to prepare an aqueous slurry having a concentration of solids which promote rapid flotation. Typically, a solids concentration of from about 2% to about 20% by weight solids, advantageously between about 5 and 10 weight percent solids, is preferred. The aqueous coal slurry is conditioned with the collector and promoter, and any other adjuvants, by vigorously mixing or agitating the slurry prior to flotation in conventional manner. It should be noted that promoters can be used in separate form or can be admixed with the collector or the frother for use in the present invention.

Typical commercial coal froth flotation operations provide a pH adjustment of the aqueous coal slurry prior to and/or during flotation to a value of about 4 to about 9 and preferably about 4 to 8. Such pH adjustment generally promotes the greatest coal recovery, though flotation at the natural coal pH is possible. If the coal is acidic in character, the pH adjustment is made generally by adding an alkaline material to the coal slurry. Suitable alkaline materials include, for example, soda ash, lime, ammonia, potassium hydroxide or magnesium hydroxide, and the like, though sodium hydroxide is preferred. If the aqueous coal slurry is alkaline in character, an acid is added to the aqueous coal slurry. Suitable acids include, for example, mineral acids such as sulfuric acid, hydrochloric acid, and the like. The conditioned and pH-adjusted aqueous coal slurry is aerated in a conventional flotation machine or bowl to float the coal. The frothing agent or frother preferably is added to the aqueous coal slurry just prior to flotation or in the flotation cell itself.

The following examples show how the present invention can be practiced but should not be construed as limiting. In this application, all units are in the metric system, and all percentages and proportions are by weight, unless otherwise expressly indicated. Also, all references cited herein are expressly incorporated herein by reference.

IN THE EXAMPLES

Coal subjected to evaluation was comminuted to a particle size of less than 28 Tyler mesh (0.589 mm) and then dispersed in water for conditioning with fuel oil collector and various alcohol frothers for about one minute. The floats were conducted at about 6.67% solids slurry of the conditioned coal particles which slurry was pH adjusted to 7.0 with sodium hydroxide. The various coals evaluated varied in ash content as follows: Ohio coal, about 33% ash; Western Kentucky coal, about 15% ash; and West Virginia coal, about 21% ash.

EXAMPLE 1

Several esters of 2,2,4-trimethyl-1,3-pentanediol (TMPD) were evaluated as frothers at a dosage of 0.18 gm/kg of coal. The frother candidates along with #2 diesel oil collector (dosage of 0.32 gm/kg) were used to condition the coal prior to flotation of Ohio coal (33% ash). The frother candidates (except for Run No. 195 which employed TMPD neat) were the reaction product of TMPD and various carboxylic acids. The following results were obtained.

TABLE 1

| Run | Frother | | No. of | Concentrate | Ash | Coal Recovery |
|---|---|---|---|---|---|---|
| No. | Alcohol | Acid | Carbons | (wt. %) | (wt. %) | (wt. %) |
| 195 | TMPD | — | — | 43.2 | 17.6 | 54.8 |
| 197 | TMPD | Acetic Anhydride | 10 | 61.2 | 16.5 | 77.6 |
| 199 | TMPD | iso-Butyric Acid | 12 | 58.3 | 14.6 | 75.4 |
| 196 | TMPD | Heptanoic Acid | 15 | 41.9 | 15.0 | 53.3 |
| 198 | TMPD | Decanoic Acid | 18 | 20.0 | 16.8 | 25.8 |

The froth produced in Run No. 196 was unstable and the froth produced in Run No. 198 contained large unstable bubbles; hence, the poor results reported. The total number of carbon atoms in the ester-alcohol frothers were 10 in Run No. 197, 12 in Run No. 199, 15 in Run No. 196, and 18 in Run No. 198. For a TMPD ester, then, it appears that the number of carbon atoms in the ester-alcohol frother should range from about 10–15. Above 15 carbon atoms, the coal recovery diminishes to a value of less than that reported for the TMPD alone, i.e. no benefit from the ester group is seen. Within the carbon atom range of 10–15 unexpected high recoveries of coal are experienced.

EXAMPLE 2

Traditional coal technology teaches that lower alkanol frothers are the frothers of choice with optimum coal recovery occurring at about 6–9 total carbon atoms. Higher alkanols (eg. $C_{10}$ and above) do not provide the required degree of frothing functionality for acceptable recoveries of coal. The inventive ester-alcohols not only provide high coal recovery values than are provided from such conventional alkanol frothers, but provide such higher recoveries at higher total numbers of carbon atoms. In order to demonstrate the uniqueness of the ester-alcohol frothers of the present invention, a series of conventional alkanol frothers of varying chain length were evaluated and compared to the novel ester-alcohol frothers. The first series of runs used 0.25 g/kg of #2 oil collector and 0.25 g/kg of alcohol frother for Ohio coal (33% ash) while the second series of runs used the same dosage of collector and 0.15 g/kg of alcohol frother for Western Kentucky coal (15% ash). The following results were recorded.

TABLE 2

| Run | Alcohol Frother | | Concentrate | Ash | Coal Recovery |
|---|---|---|---|---|---|
| No. | Type | No. of Carbons | (wt. %) | (wt. %) | (wt. %) |
| Ohio Coal | | | | | |
| 914 | Isobutyl Alcohol | 4 | 7.4 | 12.0 | 8.1 |
| 913 | Amyl Alcohol | 5 | 22.6 | 10.6 | 24.6 |
| 912 | MIBC | 6 | 51.1 | 11.1 | 56.0 |
| 911 | 2-Heptanol | 7 | 59.8 | 12.4 | 63.8 |
| 910 | 2-Ethyl Hexanol | 8 | 53.5 | 11.4 | 57.9 |
| 909 | Isodecyl Alcohol | 10 | 32.8 | 10.9 | 36.3 |
| 908 | Tridecyl Alcohol | 13 | 18.0 | 10.1 | 19.9 |
| 907[a] | TMPD iso-Butyrate | 12 | 68.1 | 12.8 | 73.0 |
| 918[b] | TMPD iso-Butyrate (crude) | 12 | 70.3 | 11.9 | 75.5 |
| Western Kentucky Coal | | | | | |
| 904 | Isobutyl Alcohol | 4 | 5.1 | 17.8 | 5.3 |
| 903 | Amyl Alcohol | 5 | 9.2 | 13.6 | 10.2 |
| 902 | MIBC | 6 | 16.7 | 13.5 | 17.7 |
| 100 | 2-Heptanol | 7 | 30.9 | 15.0 | 32.1 |
| 899 | 2-Ethyl Hexanol | 8 | 32.2 | 12.6 | 34.6 |
| 898 | Isodecyl Alcohol | 10 | 36.7 | 10.3 | 41.2 |
| 897 | Tridecyl Alcohol | 13 | 15.6 | 9.5 | 17.4 |

TABLE 2-continued

| Run No. | Alcohol Frother Type | No. of Carbons | Concentrate (wt. %) | Ash (wt. %) | Coal Recovery (wt. %) |
|---|---|---|---|---|---|
| 896[a] | TMPD iso-Butyrate | 12 | 39.8 | 12.9 | 42.8 |

[a]TMPD iso-Butyrate is 2,2,4-trimethyl-1,3-pentanediol mono-isobutyrate (the frother of Run No. 199 of Example 1).
[b]TMPD iso-Butyrate (crude) is a crude (undistilled) grade of this ester-alcohol which contains esters, alcohols, etc. residual from its manufacture.

The above-tabulated results reveal that the conventional alkanol frothers provide maximum coal recoveries between about 6–8 carbon atoms for the Ohio coal and between about 7–10 carbon atoms for the Western Kentucky coal. Unexpectedly, the 12 carbon atom ester-alcohol frothers provided greater coal recoveries than did any of the conventional alkanol frothers. These results are vividly seen by viewing the drawing which graphically depicts such results.

EXAMPLE 3

Additional evaluation of the ester-alcohol frothers was undertaken on a variety of different coals having different ash contents. For the Ohio coal (33% ash) the dosage of #2 diesel oil collector was about 0.675 kg/gm of coal, and for the West Virginia (21% ash) and Western Kentucky (15% ash) coals the dosage of #2 diesel oil collector was about 0.225 g/kg. The frothers were employed at a 0.225 g/kg dosage in all runs. The following results were recorded for the MIBC control and the inventive ester-alcohol frothers.

TABLE 3

| Run No. | Frother Alcohol | Frother Acid | No. of Carbons | Concentrate (wt. %) | Ash (wt. %) | Coal Recovery (wt. %) |
|---|---|---|---|---|---|---|
| Ohio Coal | | | | | | |
| 407 | MIBC | — | — | 18.1 | 15.5 | 26.8 |
| 408 | TMPD | iso-Butyric Acid | 12 | 33.2 | 17.2 | 46.8 |
| 409[a] | P.O. | Acetic Acid | 14 | 30.3 | 17.8 | 44.1 |
| West Virginia Coal | | | | | | |
| 411 | MIBC | — | — | 15.5 | 8.9 | 17.7 |
| 412 | TMPD | iso-Butyric Acid | 12 | 31.5 | 9.0 | 36.2 |
| 413[a] | P.O. | Acetic Acid | 14 | 37.6 | 9.2 | 42.8 |
| 414[b] | P.O. | Heptanoic Acid | 19 | 42.5 | 9.9 | 48.1 |
| 415[c] | TMP | Heptanoic Acid | 13 | 23.2 | 7.6 | 27.1 |
| Western Kentucky Coal | | | | | | |
| 417 | MIBC | — | — | 44.3 | 7.4 | 47.6 |
| 418 | TMPD | iso-Butyric Acid | 12 | 69.8 | 7.4 | 74.7 |
| 419[a] | P.O. | Acetic Acid | 14 | 74.4 | 7.8 | 79.3 |
| 420[b] | P.O. | Heptanoic Acid | 19 | 74.4 | 7.5 | 80.4 |
| 422[d] | Hexyl Alcohol | PG/Maleic Anhydride | 13 | 65.1 | 7.5 | 70.0 |

[a]4 moles of propylene oxide (P.O.) reacted with 1 mole of acetic acid.
[b]4 moles of propylene oxide (P.O.) reacted with 1 mole of heptanoic acid.
[c]1:1 reaction product of TMP (trimethylolpropane) and heptanoic acid.
[d]reaction product of propylene glycol (PG) and maleic anhydride (1:1 molar ratio) further reacted with 1 mole of hexyl alcohol.

The above-tabulated results demonstrate the effectiveness of the frothers on a variety of coals having varying ash contents. The total number of carbon atoms ranged up to 19 and still an effective frother resulted because of the ester group.

EXAMPLE 4

Further work was conducted on the novel frothers (0.25 g/kg) on Ohio coal (33% ash) using #2 diesel oil in a dosage of 0.25 g/kg of coal.

TABLE 4

| Run No. | Frother | Concentrate (wt. %) | Ash (wt. %) | Coal Recovery (wt. %) |
|---|---|---|---|---|
| 207 | MIBC | 35.9 | | 48.9 |

TABLE 4-continued

| Run No. | Frother | Concentrate (wt. %) | Ash (wt. %) | Coal Recovery (wt. %) |
|---|---|---|---|---|
| 205 | 6.5 moles P.O. + Propylene Glycol | 55.3 | | 71.4 |
| 207 | 6.5 moles P.O. + Adipic Acid | 56.8 | | 73.7 |

The propoxylated propylene glycol frother per Leja supra is a known frother as is the MIBC. The ester group of the novel propoxylated adipic acid frother provided a greater recovery of coal than did the conventional propoxylated propylene glycol. Note that the inventive diester diol (Run No. 207) has an average of 25.5 carbon atoms per molecule and a molecular weight in excess of 500.

I claim:

1. In a froth flotation process wherein solid coal particles are selectively separated under coal froth flotation conditions as a froth phase from remaining solid feed particles as an aqueous phase in the presence of a coal particle collector and an alcohol frother, the improvement characterized by said alcohol frother comprising a polyhydroxy frothing alcohol which has been modified to contain a carboxylic acid ester linkage where the carboxylic acid moeity contains between about 1 and 7 carbon atoms, said polyhydroxy frothing alcohol selected from the group consisting of a diol, a triol, a mixture of a diol and a monool wherein a dicarboxylic acid is used to modify said mixture, a polyoxyethylene glycol, a polyoxypropylene glycol, and mixtures thereof, the resulting ester-alcohol frothing agent having at least one hydroxyl group residual from said polyhydroxy frothing alcohol and providing greater coal recovery than use of said polyhydroxy frothing alcohol as the frothing agent.

2. The process of claim 1 wherein said frother is the reaction product of a monocarboxylic acid and a diol, said reaction product having between about 6 and 19 carbon atoms.

3. The process of claim 1 wherein said frother is the reaction product of a monocarboxylic acid or dicarboxylic acid and a polyoxyalkylene glycol wherein said reaction product has from between about 6 and 30 carbon atoms.

4. The process of claim 1 wherein said frother is the reaction product of a monocarboxylic acid and a triol wherein the reaction product has between about 6 and 19 carbon atoms.

5. The process of claim 1 wherein said frother is the reaction product of a dicarboxylic acid, a glycol, and a monool, wherein the reaction product has from between about 6 and 19 carbon atoms.

6. The process of claim 1 wherein said frother is the reaction product of 2,2,4-trimethyl-1,3-pentanediol and a monobasic acid wherein said reaction product has from between about 10 and 15 carbon atoms.

7. The process of claim 1 wherein said frother is present in a proportion of between about 0.05 and 0.5 g/kg of coal.

8. The process of claim 1 wherein said frother has at least one secondary hydroxyl group.

9. The process of claim 1 wherein said frother contains alkyl group branching.

10. The process of claim 9 wherein said frother has at least one secondary hydroxyl group.

11. In a froth flotation process wherein solid coal particles are selectively separated under coal froth flotation conditions as a froth phase from remaining solid feed particles as an aqueous phase in the presence of a coal particle collector and an alcohol frother, the improvement characterized by said alcohol frother comprising the reaction product of a $C_1$–$C_7$ mono or dibasic acid and a polyhydroxy frothing alcohol, said polyhydroxy frothing alcohol selected from the group consisting of a diol, a triol, a mixture of a diol and a monool wherein said acid is a dibasic acid, a polyoxyethylene glycol, a polyoxypropylene glycol, and mixtures thereof, the resulting ester-alcohol frothing agent having at least one secondary hydroxyl group residual from said polyhydroxy frothing alcohol, containing alkyl branching, and providing greater coal recovery than the use of said polyhydroxy frothing alcohol as the frothing agent, said frothing agent being present in a proportion of from between about 0.05 and about 0.5 g/kg of coal.

12. The process of claim 11 wherein said alkyl branching includes methyl groups.

13. The process of claim 11 wherein said frother is the reaction product of a monocarboxylic acid and a diol, said reaction product having between about 6 and 19 carbon atoms.

14. The process of claim 11 wherein said frother is the reaction product of a monocarboxylic acid or dicarboxylic acid and a polyoxyethylene or polyoxypropylene glycol wherein said reaction product has from between about 6 and 30 carbon atoms.

15. The process of claim 11 wherein said frother is the reaction product of a monocarboxylic acid and a triol wherein the reaction product has between about 6 and 19 carbon atoms.

16. The process of claim 11 wherein said frother is the reaction product of a dicarboxylic acid, a glycol, and a monool, wherein the reaction product has from between about 6 and 19 carbon atoms.

17. The process of claim 11 wherein said frother is the reaction product of 2,2,4-trimethyl-1,3-pentanediol and a monocarboxylic acid wherein the reaction product has from between about 10 and 15 carbon atoms.

18. The process of claim 11 wherein said collector is fuel oil in a dosage of from about 0.2 to about 2.5 g/kg of coal.

19. The process of claim 18 wherein the frother is a reaction product of 2,2,4-trimethyl-1,3-pentanediol and a monobasic acid wherein said reaction product has from between about 10 and 15 carbon atoms.

* * * * *